US006962264B2

(12) United States Patent
Zilberman

(10) Patent No.: US 6,962,264 B2
(45) Date of Patent: Nov. 8, 2005

(54) RECEPTACLE WITH COMPARTMENTED PERIPHERAL WALL FOR DISPLAY OF PERSONALIZED GRAPHICS/TEXT

(76) Inventor: Guy Zilberman, 185 E. Palisade Ave., Englewood, NJ (US) 07631

( * ) Notice: Subject to any disclaimer, the term of this patent is extended or adjusted under 35 U.S.C. 154(b) by 114 days.

(21) Appl. No.: 10/205,445

(22) Filed: Jul. 26, 2002

(65) Prior Publication Data

US 2003/0038132 A1 Feb. 27, 2003

Related U.S. Application Data

(60) Provisional application No. 60/314,576, filed on Aug. 24, 2001.

(51) Int. Cl.[7] ..... B65D 25/54
(52) U.S. Cl. ..... 220/662; 220/665
(58) Field of Search ..... 220/662, 665, 220/62.14

(56) References Cited

U.S. PATENT DOCUMENTS 4,001,959 A * 1/1977 Grendahl ..... 40/720
4,047,633 A 9/1977 Trombly
4,273,245 A * 6/1981 Hartinger Machalek ... 215/12.1
4,595,021 A * 6/1986 Shimizu et al. ..... 600/578
4,830,217 A * 5/1989 Dufresne et al. ..... 422/102
4,941,590 A * 7/1990 Pantaleo et al. ..... 220/662
4,979,325 A * 12/1990 White ..... 40/661
5,036,998 A * 8/1991 Dunn ..... 220/23.87
D342,815 S 12/1993 Shafer
5,275,277 A * 1/1994 Gallegos ..... 206/217
5,553,733 A 9/1996 Rosenthal
5,553,735 A * 9/1996 Kimura ..... 362/101
5,562,229 A 10/1996 Callahan
5,894,948 A 4/1999 Yeh
6,241,095 B1 * 6/2001 Yencheng ..... 206/459.1
6,253,918 B1 * 7/2001 Greiner ..... 206/457

* cited by examiner

*Primary Examiner*—Joseph C. Merek
(74) *Attorney, Agent, or Firm*—Galbreath Law Offices, P.C.; John A. Galbreath

(57) ABSTRACT

A receptacle with compartmented peripheral walls for displaying personalized and changeable graphics is disclosed. The receptacle has an inner cylinder and a transparent outer cylinder which are spaced apart by vertical spacers which divide the cavity between the cylinders into compartments, each of which houses a removable sheet of graphic material. In a preferred embodiment, each compartment is sized to hold a standard, stock sized paper, such as 8½"×11", so the graphics may be quickly and easily changed.

13 Claims, 2 Drawing Sheets

RECEPTACLE WITH COMPARTMENTED PERIPHERAL WALL FOR DISPLAY OF PERSONALIZED GRAPHICS/TEXT

This application is related to Provisional U.S. Patent Application, Ser. No. 60/314,576, filed on Aug. 24, 2001.

BACKGROUND OF THE INVENTION

1. Field of the Invention

The present invention relates to receptacles, especially those typically used as wastebaskets in a domestic or office environment. More particularly, the invention comprises a receptacle having a transparent peripheral wall which is compartmented to receive a plurality of sheets of standard paper sizes, which may bear personalized graphics or text.

2. Description of the Prior Art

People have always been interested in personalizing their surroundings to display their individuality. Over the years a number of different items, many of them various types of receptacles which may be personalized by the inclusion of personal graphic or textual matter, have been developed.

U.S. Pat. No. 5,894,948, issued to Frank Yeh on Apr. 20, 1999, presents a Novelty Mug Assembly having an inner mug and a transparent outer mug. Either a flat sheet formed into a cylinder or a preformed cylinder may be fitted between the inner mug and outer mug, the cylinder either having a graphic or textual design already thereon or being customizable by the user. Once the cylinder is placed within the outer mug, the inner mug is removably inserted, with a seal device placed therebetween. The cylinder may be replaced at the users discretion. By contrast, the periphery of the present invention is compartmentalized to receive a plurality of decorative sheets.

In U.S. Pat. No. 5,562,229, issued to Edward Callahan on Oct. 8, 1996, a DECORATIVE RECEPTACLE WITH REMOVABLE COVER is disclosed. An inner receptacle body has flanges at its upper and lower end which releasably hold an outer, tubular sidewall member in place. A base member is held in place by a plurality of pins which engage corresponding holes in the bottom of the tubular sidewall member. The tubular sidewall member may thereby be removed for cleaning or replacement with another sidewall member having the same or a different graphic design thereon. While Callahan provides a changeable, decorative cover for a receptacle, no provision is made for separately housing sheets of decorative material, as does the present invention.

Fumiyo Kimura discloses a VESSEL WITH DISPLAY FUNCTION in his U.S. Pat. No. 5,553,735, issued on Sep. 10, 1996. Kimura presents two distinct embodiments of his vessel. In a first embodiment an inner and an outer shell with a gap therebetween is formed as a single unit, closed at the top and sealed with a base unit. In several different versions of the second embodiment, an inner shell is inserted into an outer shell, the two elements being removably joined around the periphery of the upper edges. A cavity between the inner and outer shells may receive interchangeable graphic or textual displays. While Kimura provides for changing displays within the vessel, the separate and distinct chambers of the present invention are absent U.S. Pat. No. 5,553,733, issued to Linda M. Rosenthal on Sep. 10, 1996, sets forth an ARTICLE COVER. A rigid base element has a pliable peripheral wall attached around its perimeter, the wall being extendable to cover the exterior of an article placed therewithin. The free end of the peripheral wall is adjustable by an elastic band to fit over various sizes of items.

Edgar F. Trombly discloses an ICE CONTAINER in his U.S. Pat. No. 4,047,633, issued on Sep. 13, 1977. An inner container and an outer container are spaced apart one from the other and bonded together so as to form a dead air space therebetween. Decorative material may be placed between the inner container and a transparent outer container, but once the unit is sealed, the material can not be changed, as in the present invention.

None of the above inventions and patents, taken either singly or in combination, is seen to describe the instant invention as claimed.

SUMMARY OF THE INVENTION

The present invention satisfies the desire by many individuals to personalize a receptacle by providing the ability to changeably display graphic or textual matter of interest to themselves or to others. An inner cylinder, closed at the bottom and open at the top is fitted within a substantially transparent outer cylinder, also closed at the bottom and open at the top. A plurality of vertical spacers ensure a uniform gap between the inner and outer cylinders, as well as dividing the periphery into uniformly dimensioned chambers for receiving sheets of paper, or other thin material, bearing graphic or textual matter. The gap between the inner and outer cylinders is sealed by a removable gasket placed between the open ends thereof.

Accordingly, it is a principal object of the invention provide a receptacle which may be easily decorated with graphic or textual matter.

It is another object of the invention to provide a waste-basket on which the graphic or textual matter may be easily changed, at the user's discretion.

It is a further object of the invention to provide a waste-basket offering protection from liquids and dirt to the graphic or textual matter displayed thereon.

Still another object of the invention is to provide a waste-basket which is light weight.

An additional object of the invention is to provide a waste-basket which can withstand a reasonable degree of abuse.

It is again an object of the invention to provide a waste-basket which is relatively inexpensive to produce, and therefore to purchase.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 2:
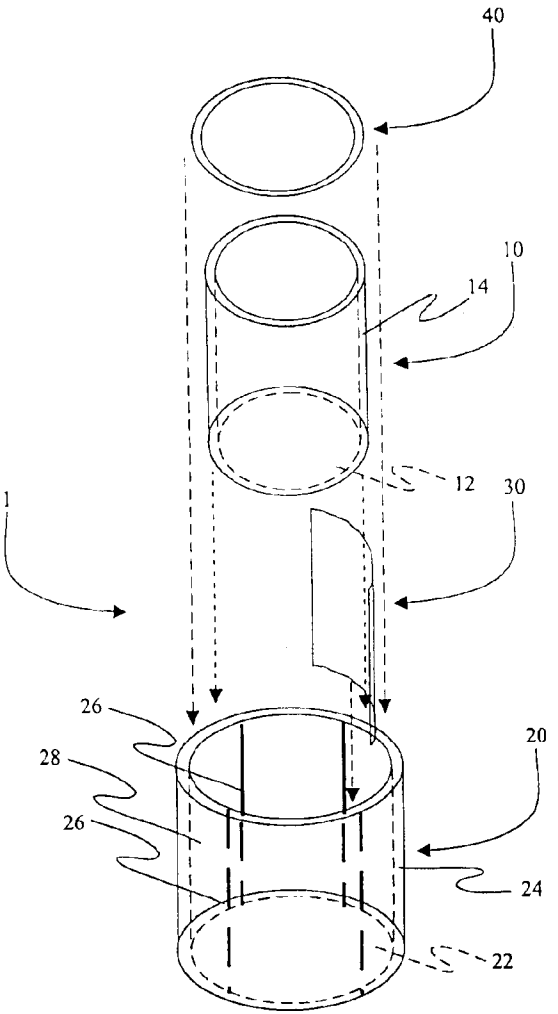
FIG. 2 is an exploded, environmental perspective view of the inventive receptacle.
Figure 1:
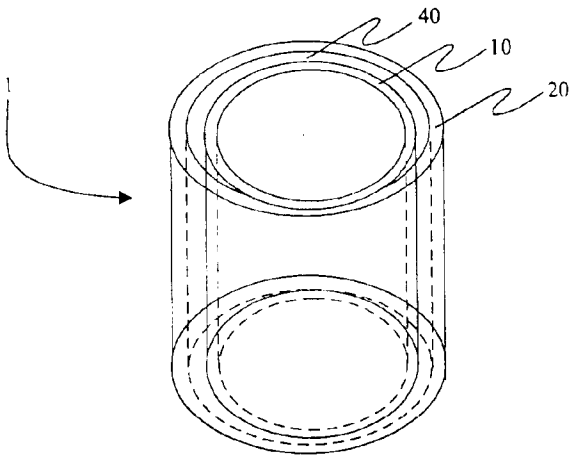
FIG. 1 is an environmental perspective view of the inventive receptacle.

The receptacle 1 of the present invention is depicted generally at FIGS. 1 and 2. The primary elements of receptacle 1 are inner cylinder 10, outer cylinder 20, graphic sheet 30, and gasket 40.

Inner cylinder 10 consists of a bottom panel 12 and a peripheral wall 14. Bottom panel 12 and peripheral wall 14 are formed, preferably of a polymeric material, by any commonly known method, such as, but not limited to, extrusion, injection molding, or vacuum forming. Bottom panel 12 and peripheral wall 14 may be formed as a single unit or as separate elements and joined by a method such as, but not limited to, chemical welding. Bottom panel 12 and peripheral wall 14 may, optionally, be of an opaque, translucent, or transparent material, therefore it would be evident to one skilled in the art that inner cylinder 10 could be formed of other materials, such as, but not limited to, a metal, without departing from the spirit of the invention.

Outer cylinder 20 consists of a bottom panel 22, a peripheral wall 24, and a plurality of vertical spacers 26 formed on the interior surface of peripheral wall 24 and equally spaced thereabout. Like bottom panel 12 and peripheral wall 14, bottom panel 22 and peripheral wall 24 are formed, preferably of a polymeric material, by methods such as, but not limited to, extrusion, injection molding or vacuum forming. Bottom panel 22 and peripheral wall 24, too, may be formed as a single unit or as separate elements and joined by a method such as, but not limited to, chemical welding. Since the intent of the present invention is to display graphic or textual matter through outer cylinder 20, peripheral wall would, preferably, be of a transparent material, although an opaque or translucent material could be utilized.

Vertical spacers 26 are uniformly spaced apart from one another around the inner surface of peripheral wall 24. Each vertical spacer 26 has a length extending from bottom panel 22 to a point proximate the upper edge of peripheral wall 24, a nominal, uniform thickness which spaces peripheral walls 14 and 24 apart from one another by a measurement sufficient to receive the thickness of a graphic sheet 30 (graphic sheet 30 will be further discussed hereinbelow), and a nominal, uniform width which separates the space formed between peripheral walls 14 and 24 into separate compartments 28, each compartment 28 is adapted to receive a graphic sheet 30.

Receptacle 1 could be produced in various sizes wherein compartments 28 are adapted to hold 8½"×11", 8½×14", or 210 mm×297 mm sheets of paper, as well as other standard sheet sizes. While the intent of the present invention is to utilize standard paper sizes for graphic sheets 30, it would be evident to one skilled in the art that other sizes may be utilized or that multiple sizes could be utilized without departing from the spirit of the invention. Vertical spacers 26 are dimensioned to fit snugly against peripheral wall 14, thereby preventing graphic sheets 30 from slipping between vertical spacer 26 and peripheral wall 14.

A removable gasket 40, preferably of a flexible, transparent material, occupies the gap between the upper edges of inner cylinder 10 and outer cylinder 20, preventing the ingress of dirt and/or moisture and securing the graphic sheets 30 within the cavities created between peripheral walls 14 and 24 and vertical spacers 26. It would be evident to one skilled in the art that gasket 40 could be translucent or opaque, as well as transparent.

It would be evident to one skilled in the art that vertical spacers 26 could be formed as an integral element of peripheral wall 24 or joined to peripheral wall 24 by a method such as, but not limited to, chemical welding. It would be further evident to one skilled in the art that vertical spacers 26 could be spaced around the outer surface of peripheral wall 14, in lieu of the inner surface of peripheral wall 24, without departing from the spirit of the present invention. It would, likewise, be evident to one skilled in the art that inner cylinder 10 could be formed without a bottom panel 12, with bottom panel 22 serving as the interior bottom of receptacle 1.

While the term "cylinder" has been used in disclosing the shape of inner cylinder 10 and outer cylinder 20, it would be evident to one skilled in the art that inner cylinder 10 and outer cylinder 20 could be of differing shapes, including, but not limited to, elliptical or polygonal, without departing from the spirit of the present invention. Inner cylinder 10 and outer cylinder 20, regardless of the shape used, may also be frustal (having tapering sides). However, if a frustal shape is utilized, vertical spacers 26 would have a slight wedge shape in order to maintain a uniform measurement therebetween from the bottom to the top of receptacle 1.

Graphic sheets 30 consist of a material such as, but not limited to, paper, cloth or a thin polymeric sheet bearing either a pictorial or textual graphic, or both. As has been stated hereinabove, the intent of the present invention is to be able to utilize standard, stock paper sizes for graphic sheets 30. The graphic may be applied to graphic sheet 30 by any means known in the art, including, but not limited to, printing, stitching, and the like.

Figure 4:
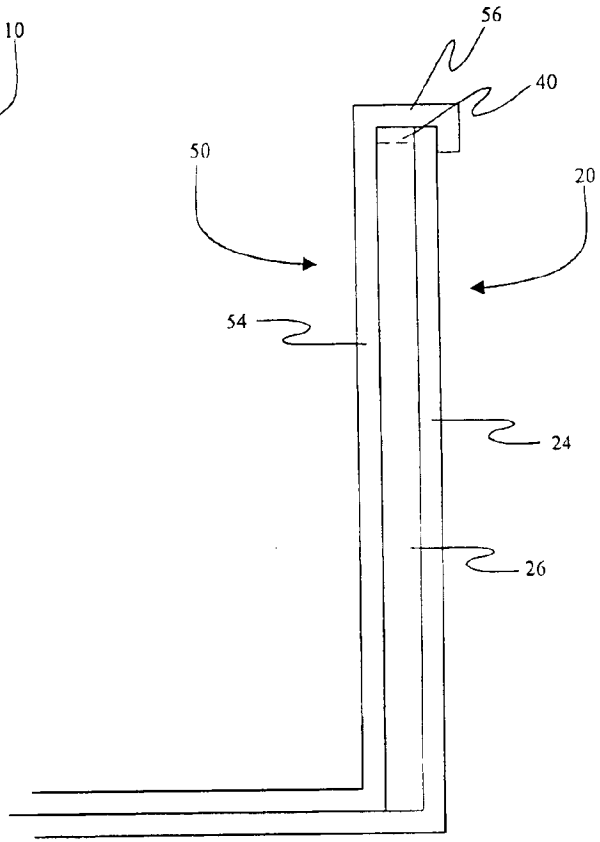
FIG. 4 is a cross sectional view of a second embodiment of the inventive receptacle.
Figure 3:
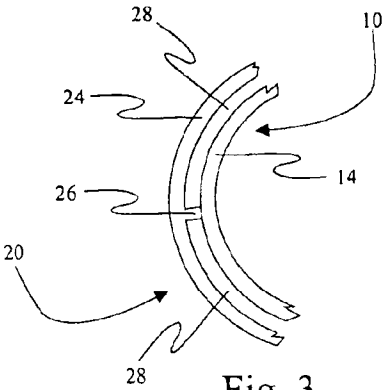
FIG. 3 is a detailed plan view of one of the vertical spacers of the present invention.

In a second embodiment, inner cylinder 50 (shown in cross section at FIG. 4) further includes a lip 56 extending outwardly around the upper edge of peripheral wall 54. Lip 56 forms an inverted "U" extending outwardly and downwardly over the upper edge of peripheral wall 24. A seal may be formed between inner cylinder 50 and outer cylinder 20 by a system wherein the snug relationship between peripheral wall 14 and vertical spacers 26 constrains the upper edge of peripheral wall 24 in close juxtaposition with lip 56. Optionally, a gasket 40 may seal the gap between peripheral wall 14 and peripheral wall 24 or the gap between peripheral wall 24 and lip 56. Vertical spacers 26 are formed on the inner surface of outer cylinder 20 or the outer surface of inner cylinder 10, as in the preferred embodiment described hereinabove, although it would, again, be evident to one skilled in the art that vertical spacers 26 could be formed on the outer surface of inner cylinder 50.

Figure 5:
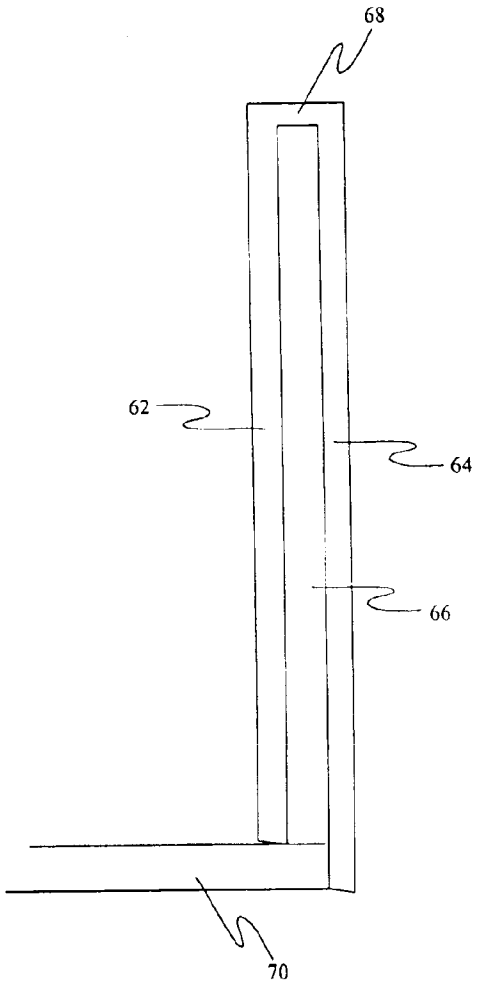
FIG. 5 is a cross sectional view of a third embodiment of the present invention.

In a third embodiment (shown in cross section at FIG. 5) an inner peripheral wall 62 and an outer peripheral wall 64 are formed as a single element, joined at the top thereof by a bridge 68, with vertical spacers 66 therebetween, as in the preferred embodiment described hereinabove. The bottom edge of outer peripheral wall 64 extends beyond the bottom edge of inner peripheral wall 62 such that a bottom panel 70 may be frictionally held within the perimeter of outer peripheral wall 64, the upper surface of bottom panel 70 abutting the bottom edge of inner peripheral wall 62. It would be evident to one skilled in the art that bottom panel 70 could be restrained within the perimeter of outer peripheral wall 64 by any variety of clipping method, of which many are known in the art.

It is to be understood that the present invention is not limited to the embodiments described above, but encompasses any and all embodiments within the scope of the following claims.

What is claimed is:

1. A receptacle with compartmented peripheral walls for display of personalized graphics comprising: an inner cylinder, an outer cylinder, said inner and outer cylinders each comprising a peripheral wall, the bottom of said peripheral wall of said inner cylinder directly contacting a member extending between the bottoms of said peripheral walls of said inner and outer cylinders, said member being substantially normal to said peripheral walls of said inner and outer cylinders so as to close off a lower end a space between said peripherals walls of said inner and outer cylinders, said space containing a plurality of graphic display means for displaying graphic material, separation means for spacing said inner cylinder and said outer cylinder apart from one another and said plurality of graphic display means apart from one another, and sealing means for sealing said space formed between said inner cylinder and said outer cylinder from moisture and dirt infiltration and restraining said graphic display means within said space.

2. A receptacle with compartmented peripheral walls for display of personalized graphics, as defined in claim 1, wherein: said inner cylinder comprises a bottom panel and a peripheral wall, said peripheral wall being substantially normal to a perimeter of said bottom panel, said outer cylinder comprises a bottom panel and a peripheral wall, said peripheral wall being substantially normal to a perimeter of said bottom panel, and said separation means comprises a plurality of vertical spacers disposed between said inner cylinder and said outer cylinder.

3. A receptacle with compartmented peripheral walls for display of personalized graphics, as defined in claim 2 wherein said outer cylinder consists of one of the group: a transparent material and a translucent material.

4. A receptacle with compartmented peripheral walls for display of personalized graphics, as defined in claim 1, wherein each of said plurality of graphic display means comprises a thin sheet.

5. A receptacle with compartmented peripheral walls for display of personalized graphics, as defined in claim 4, wherein each of said sheets consists of one from the group: paper, cloth, and a polymer.

6. A receptacle with compartmented peripheral walls for display of personalized graphics, as defined in claim 1, wherein said graphic material comprises at least one from the group: pictorial graphics and textual graphics.

7. A receptacle with compartmented peripheral walls for display of personalized graphics, as defined in claim 2, wherein said plurality of vertical spacers have: a length, said length extending from a point proximate said bottom panel to a point proximate an upper edge of said peripheral walls, a predetermined thickness, said thickness adapted to space said inner cylinder and said outer cylinder apart from one another, and a predetermined width, said width adapted to space said graphic display means apart from an adjacent of said graphic display means; and said plurality of vertical spacers are uniformly spaced about a perimeter of said receptacle.

8. A receptacle with compartmented peripheral walls for display of personalized graphics, as defined in claim 1, wherein said sealing means comprises a flexible gasket, said gasket adapted for removable insertion between an upper edge of said inner cylinder and said outer cylinder.

9. A receptacle with compartmented peripheral walls for display of personalized graphics, as defined in claim 8, wherein said gasket is formed of a clear material.

10. A receptacle with compartmented peripheral walls for display of personalized graphics, as defined in claim 2, wherein said inner cylinder further comprises: a lip extending outwardly from a perimeter of an upper edge of said peripheral wall and downwardly therefrom, said lip overlapping an upper edge of said peripheral wall of said outer cylinder.

11. A receptacle with compartmented peripheral walls for display of personalized graphics, as defined in claim 10, wherein said sealing means comprises one from the group: a gasket disposed between said lip and said peripheral wall of said outer cylinder, a gasket disposed between an upper edge of said inner cylinder and said outer cylinder, and a system wherein an upper edge of said peripheral wall of said inner cylinder is constrained in close juxtaposition with said lip.

12. A receptacle with compartmented peripheral walls for display of personalized graphics comprising: an inner cylinder, said inner cylinder further comprising: a bottom panel and a peripheral wall, said peripheral wall being substantially normal to a perimeter of said bottom panel; an outer cylinder, said outer cylinder further comprising: a bottom panel and a peripheral wall, said peripheral wall being substantially normal to a perimeter of said bottom panel, at least said peripheral wall being of a transparent material; said bottom panel of said inner cylinder directly contacting said bottom panel of said outer cylinder such that said bottom panels are not spaced form each other graphic display means for displaying graphic material, said graphic display means comprising a plurality of thin sheets; separation means for spacing said inner cylinder and said outer cylinder apart from one another and said graphic display means apart from one another, said separation means comprising a plurality of vertical spacers disposed between said inner cylinders and said outer cylinder, said vertical spacers having: a length, said length extending from a point proximate said bottom panel to a point proximate an upper edge of said peripheral walls, a predetermined thickness, said thickness adapted to space said inner cylinder and said outer cylinder apart from one another, and a predetermined width, said width adapted to space said at graphic display means apart from an adjacent one of said graphic display means, said plurality of vertical spacers being uniformly spaced about a perimeter of said receptacle; and sealing means for sealing said space formed between said inner cylinder and said outer cylinder from moisture and dirt infiltration and restraining said graphic display means within said space, said sealing means comprising a clear, flexible gasket, said gasket being adapted for removable insertion between an upper edge of said inner cylinder and said outer cylinder.

13. A receptacle with compartmented peripheral walls for display of personalized graphics, as defined in claim 12, wherein said graphic display means comprises at least one of the group: pictorial graphics and textual graphics.

* * * * *